US011883752B1

(12) United States Patent
Chichester

(10) Patent No.: US 11,883,752 B1
(45) Date of Patent: Jan. 30, 2024

(54) MECHANICAL ACTION TOY

(71) Applicant: Chuggernauts, LLC, Rochester, NY (US)

(72) Inventor: Shane C. Chichester, Rochester, NY (US)

( * ) Notice: Subject to any disclaimer, the term of this patent is extended or adjusted under 35 U.S.C. 154(b) by 0 days.

(21) Appl. No.: 18/126,567

(22) Filed: Mar. 27, 2023

(51) Int. Cl.
*A63F 9/00* (2006.01)

(52) U.S. Cl.
CPC ..... *A63F 9/001* (2013.01); *A63F 2009/0012* (2013.01); *A63F 2250/024* (2013.01)

(58) Field of Classification Search
CPC ..... A63F 9/001; A63F 2009/0012; A63F 2250/024
See application file for complete search history.

(56) References Cited

U.S. PATENT DOCUMENTS

| | | | | |
|---|---|---|---|---|
| 10,369,456 | B1 * | 8/2019 | Syme | F41J 5/24 |
| 11,413,552 | B1 | 8/2022 | Wu | |
| 2007/0205554 | A1 * | 9/2007 | Elliott | A63H 1/00 273/126 R |
| 2008/0220693 | A1 | 9/2008 | Cuisinier | |
| 2009/0286451 | A1 | 11/2009 | Bar-Hen | |
| 2017/0284775 | A1 * | 10/2017 | Edmiston | F41J 3/0014 |
| 2019/0255416 | A1 | 8/2019 | Strickland et al. | |

FOREIGN PATENT DOCUMENTS

| | | | |
|---|---|---|---|
| CN | 203724734 | U | 7/2014 |
| JP | H09738 | A | 1/1997 |
| RU | 2688279 | C1 | 7/2019 |
| WO | WO2005061064 | A1 | 7/2005 |

OTHER PUBLICATIONS

Medieval Duel Game, https://www.videoman.gr/en/192329, accessed May 24, 2023.
Stab Your Friend in the Face Game, https://www.reddit.com/r/DidntKnowIWantedThat/comments/107c41c/stab_your_friend_in_the_face_game_blockem_popem/, accessed May 24, 2023.

* cited by examiner

*Primary Examiner* — Michael D Dennis
(74) *Attorney, Agent, or Firm* — David L. Principe; Phillips Lytle LLP

(57) ABSTRACT

A mechanical action toy having a first support member and a second support member for supporting first and second beverage containers in spaced apart relation. The first and second support members have elongate piercing members and elongate shield members that are configured to be used by opposing players in a game where the object is to pierce the opponent's beverage container.

16 Claims, 12 Drawing Sheets

MECHANICAL ACTION TOY

TECHNICAL FIELD

The present invention relates generally to the field of toys and novelties, and more particularly to a mechanical action toy suitable for use with a beverage container.

BACKGROUND ART

Games requiring drinking a beverage as part of the game are a very popular activity at many social events. Games involving manual dexterity, competition, and drinking beverages have also gained popularity. Accordingly, there is a need for a unique and useful game that fits this category.

BRIEF SUMMARY OF THE INVENTION

With parenthetical reference to the corresponding parts, portions or surfaces of the disclosed embodiment, merely for the purposes of illustration and not by way of limitation, the present invention meets the above described need by providing a mechanical action toy that requires drinking a beverage as part of the game.

In a first embodiment of the invention, a first support member (23) has an opening (26) defined therein. The opening (26) is configured to receive at least a portion of a first beverage container (29) to hold the first beverage container (29) in a predetermined position.

A first elongate piercing member (98) has a first end (101) and a second end (104) disposed opposite from the first end (101).

A second support member (128) has an opening (226) defined therein configured to receive at least a portion of a second beverage container (129) to hold the second beverage container (129) in a predetermined position. The second support member (128) disposed in spaced apart relation to the first support member (23).

A second elongate piercing member (131) has a first end (201) and a second end (204) disposed opposite from the first end (201).

The second end (104) of the first elongate piercing member (98) is configured to puncture the second beverage container (129), and the second end (204) of the second elongate piercing member (131) is configured to puncture the first beverage container (29).

In another aspect of the invention, the first elongate piercing member (98) is connected to the first support member (23).

In another aspect of the invention, the first elongate piercing member (98) is connected to the first support member (23) by a plurality of elongate connectors (89, 92, 95).

Another aspect of the invention is that the second elongate piercing member (131) is connected to the second support member (128).

Another aspect of the invention includes a first plate (83) disposed on the first support member (23) in front of the first beverage container (29). The first plate (83) has an opening (86) defined therein. The first plate (83) covers at least a portion of the first beverage container (29).

In yet another aspect of the invention, the toy (20) may include a base (38) supporting the first and second support members (23, 128).

A platform (35) is disposed on the first support member (23). The platform (35) is configured to support the first beverage container (29) in a position elevated from the base (38).

In another aspect of the invention, the base (38) is formed on a clamshell type enclosure (41).

Another aspect of the invention includes a first laterally extending member (74) configured to form a shoulder extending from the first support member (23).

Another aspect of the invention includes one or more connecting members (89, 92, 95), the one or more connecting members (89, 92, 95) attached at a first end to the first support member (23) and attached at a second end to the first elongate piercing member (98).

In yet another aspect of the invention, a first elongate shield member (113) has a first end (116) and a second end (119) disposed opposite from the first end (116).

In another aspect of the invention, a second elongate shield member (134) has a first end (216) and a second end (219) disposed opposite from the first end (216). The second elongate shield member (134) is disposed in spaced apart relation to the first elongate shield member (113).

Another embodiment of the invention includes a base (38) and a first support member (23) supported by the base (38). The first support member (23) has an opening (26) defined therein. The opening (26) is configured to receive at least a portion of a first beverage container (29) to hold the first beverage container (29) in a predetermined position on a platform (35) disposed above the base (38).

A first plate (83) covers at least a portion of a front surface of the first beverage container (29). The first plate (83) has an opening (86) defined therein.

A first elongate piercing member (98) has a first end (101) and a second end (104) disposed opposite from the first end (101). The first elongate piercing member (98) is connected to the first support member (23).

A first elongate shield member (113) has a first end (116) and a second end (119) disposed opposite from the first end (116). The first elongate shield member (113) is connected to the first support member (23). The first elongate shield member (113) has a shield (125) disposed at the second end (119).

A second support member (128) has an opening (226) defined therein configured to receive at least a portion of a second beverage container (129) to hold the second beverage container (129) in a predetermined position on a platform (235) above the base (238). The second support member (128) is disposed in spaced apart relation to the first support member (23).

A second plate (183) covers at least a portion of a front surface of the second beverage container (129). The second plate (183) has an opening (186) defined therein.

A second elongate piercing member (131) has a first end (201) and a second end (204) disposed opposite from the first end (201). The second elongate piercing member (131) is connected to the second support member (128).

A second elongate shield member (134) has a first end (216) and a second end (219) disposed opposite from the first end (216). The second elongate shield member (134) is connected to the second support member (128). The second elongate shield member (134) has a shield (225) disposed at the second end (219).

The first elongate piercing member (98) is configured to puncture the second beverage container (129) through the opening (186) in the second plate (183), and the second elongate piercing member (131) is configured to puncture the first beverage container (29) through the opening (86) in the first plate (83).

In another aspect of the invention, the base (38) is formed in a clam shell type enclosure (41).

Another aspect of the invention includes a first laterally extending member (74) configured to form a shoulder extending from the first support member (23).

Another aspect of the invention includes one or more connecting members (89, 92, 95). The one or more connecting members (89, 92, 95) are attached at a first end to the first support member (23) and are attached at a second end to the first elongate piercing member (98).

In another embodiment of the invention, the toy (20) provides a base (38) and a first support member (23) supported by the base (38). The first support member (23) has an opening (26) defined therein. The opening (26) is configured to receive at least a portion of a first beverage container (29) to hold the first beverage container (29) in a predetermined position on a platform (35) disposed above the base (38).

A first plate (83) is disposed on the first support member (23). The first plate (83) covers at least a portion of the first beverage container (29) and has an opening (86) defined therein.

A first elongate piercing member (98) has a first end (101) and a second end (104) disposed opposite from the first end (101). The first elongate member (98) is connected to the first support member (23).

A first elongate shield member (113) has a first end (116) and a second end (119) disposed opposite from the first end (116). The first elongate shield member (113) is connected to the first support member (23). The first elongate shield member (113) has a shield (125) disposed at the second end (119).

A second support member (128) has an opening (226) defined therein configured to receive at least a portion of a second beverage container (129) to hold the second beverage container (129) in a predetermined position on a platform (235) above the base (238). The second support member (128) is disposed in spaced apart relation to the first support member (23).

A second plate (183) is disposed on the second support member (128). The second plate (183) covers at least a portion of the second beverage container (129) and has an opening (186) defined therein.

A second elongate piercing member (131) has a first end (201) and a second end (204) disposed opposite from the first end (201). The second elongate piercing member (131) is connected to the second support member (128).

A second elongate shield member (134) has a first end (216) and a second end (219) disposed opposite from the first end (216). The second elongate shield member (134) is connected to the second support member (128). The second elongate shield member (134) has a shield (225) disposed at the second end (219).

The second end (104) of the first elongate piercing member (98) is configured to puncture the second beverage container (129) through the opening (186) in the second plate (183) in the second support member (128) and the second end (204) of the second elongate piercing member (131) is configured to puncture the first beverage container (29) through the opening (86) in the first plate (83) in the first support member (23).

DESCRIPTION OF THE PREFERRED EMBODIMENTS

Figure 1:
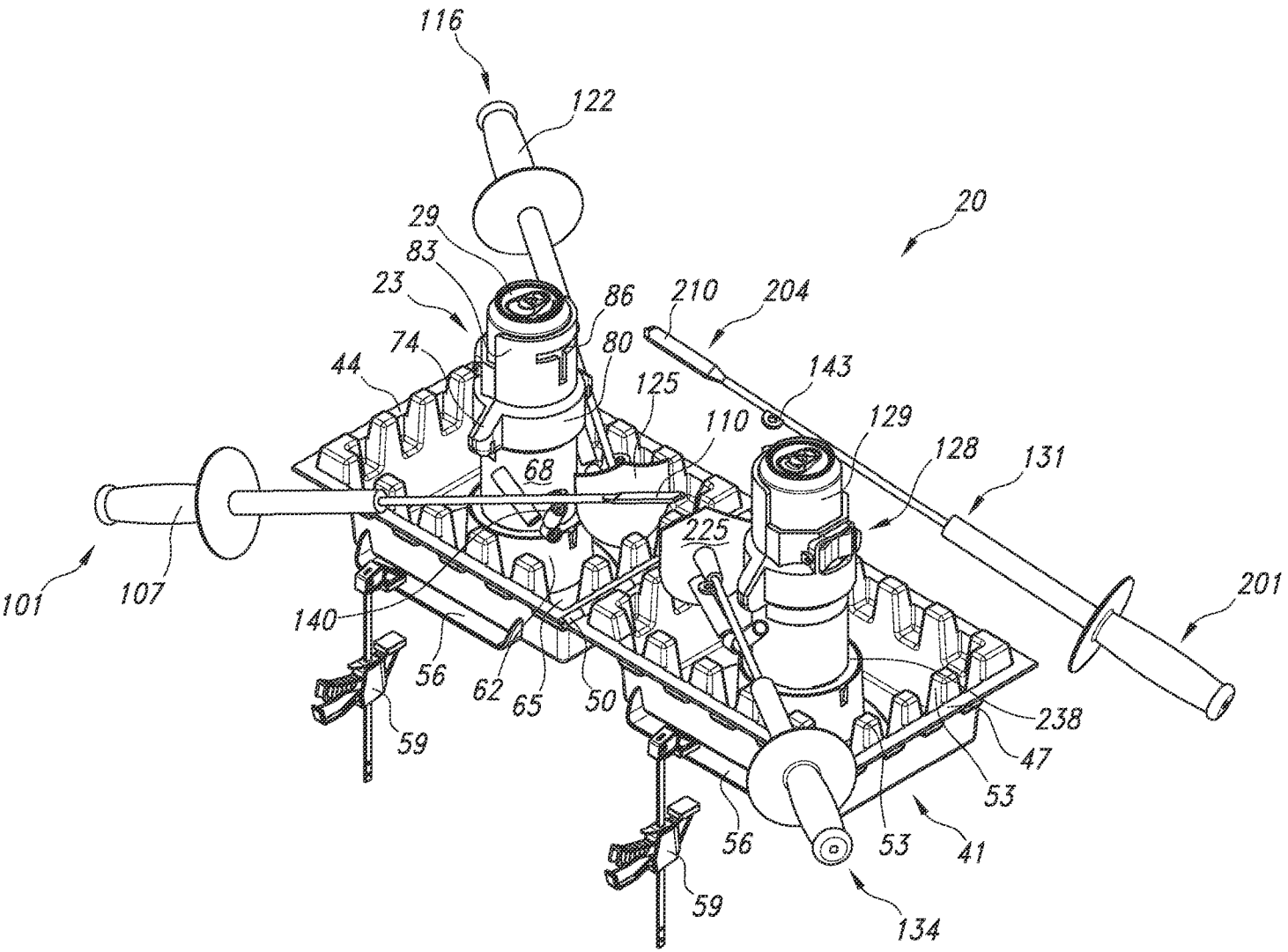
FIG. 1 is a perspective view of the mechanical toy of the present invention.
Figure 2:
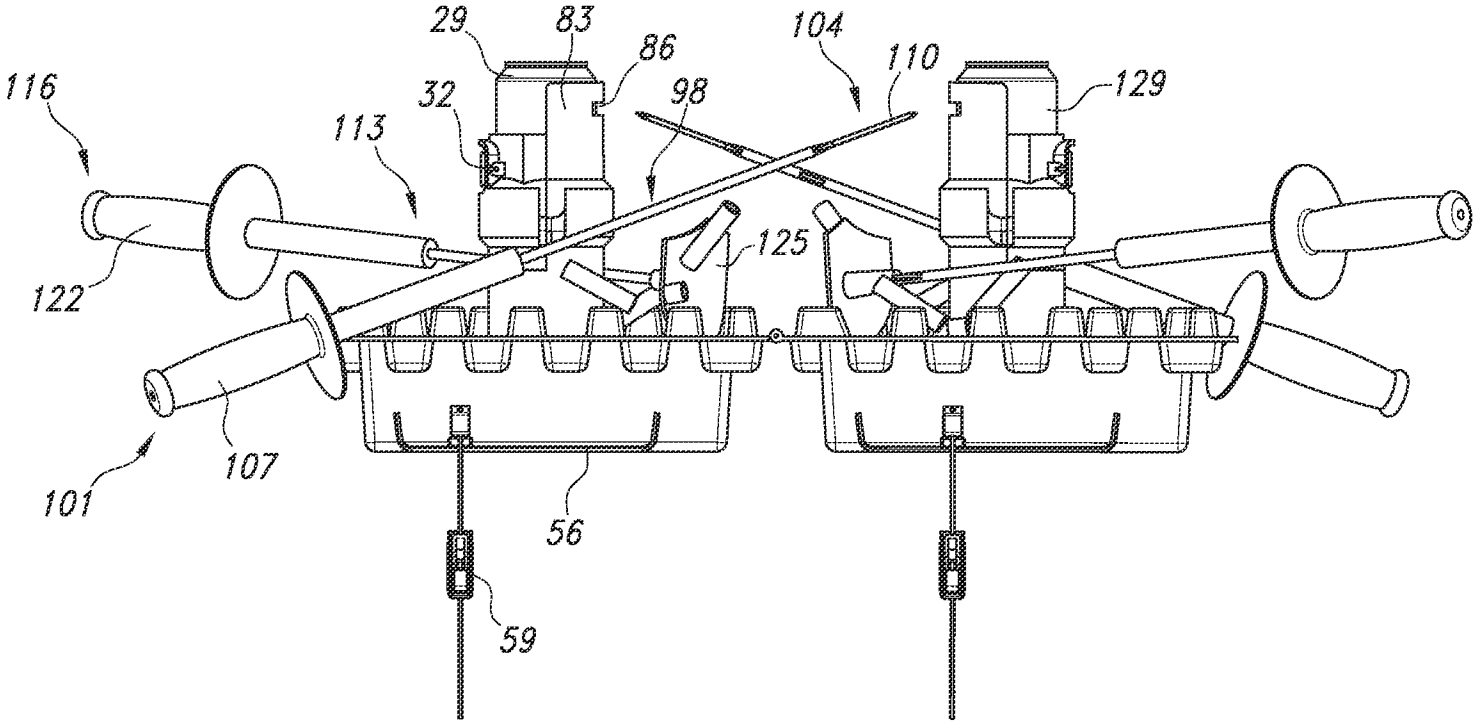
FIG. 2 is a side elevational view of the toy shown in FIG. 1.
Figure 3:
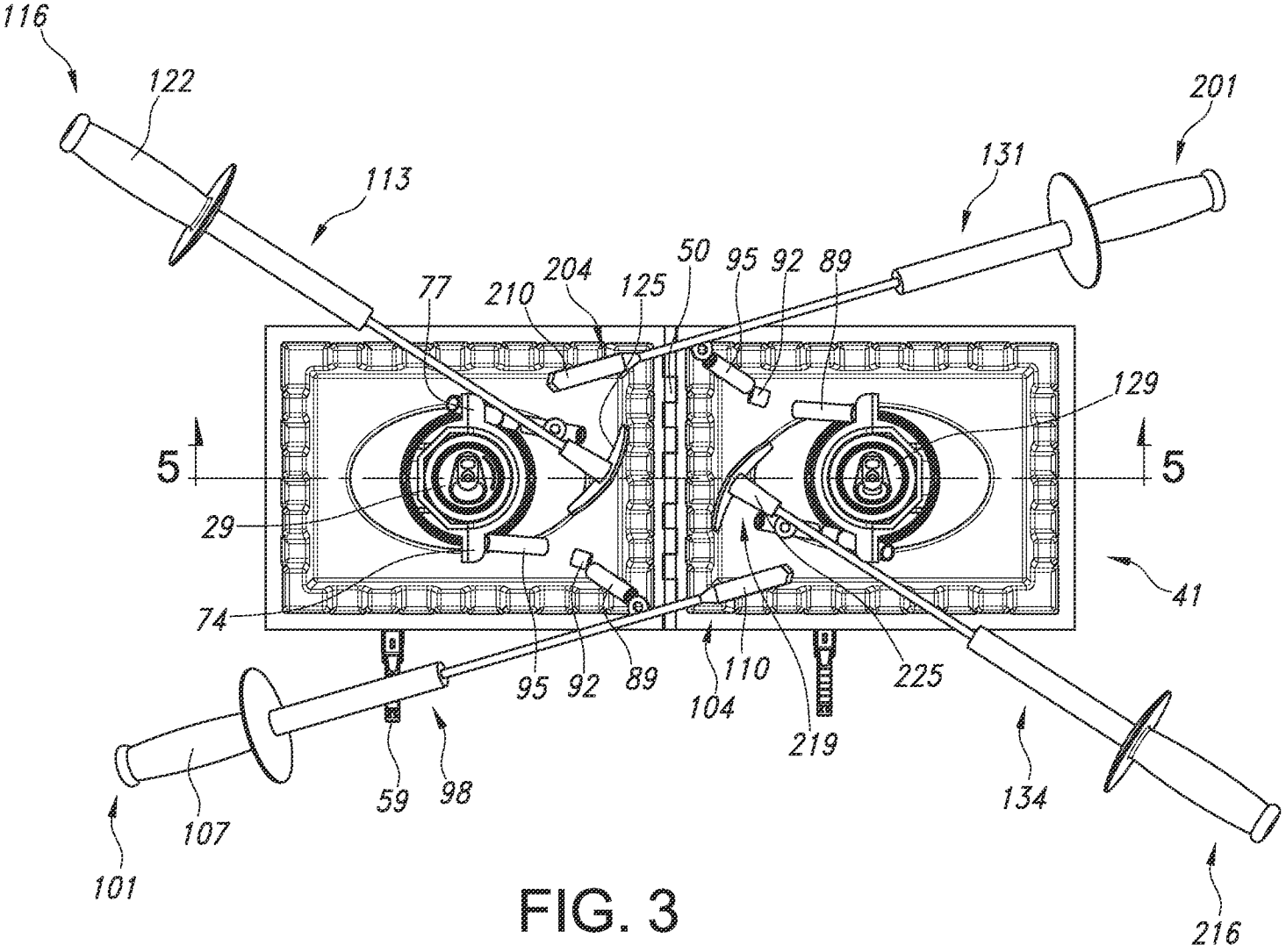
FIG. 3 is a top plan view of the toy shown in FIG. 1.
Figure 4:
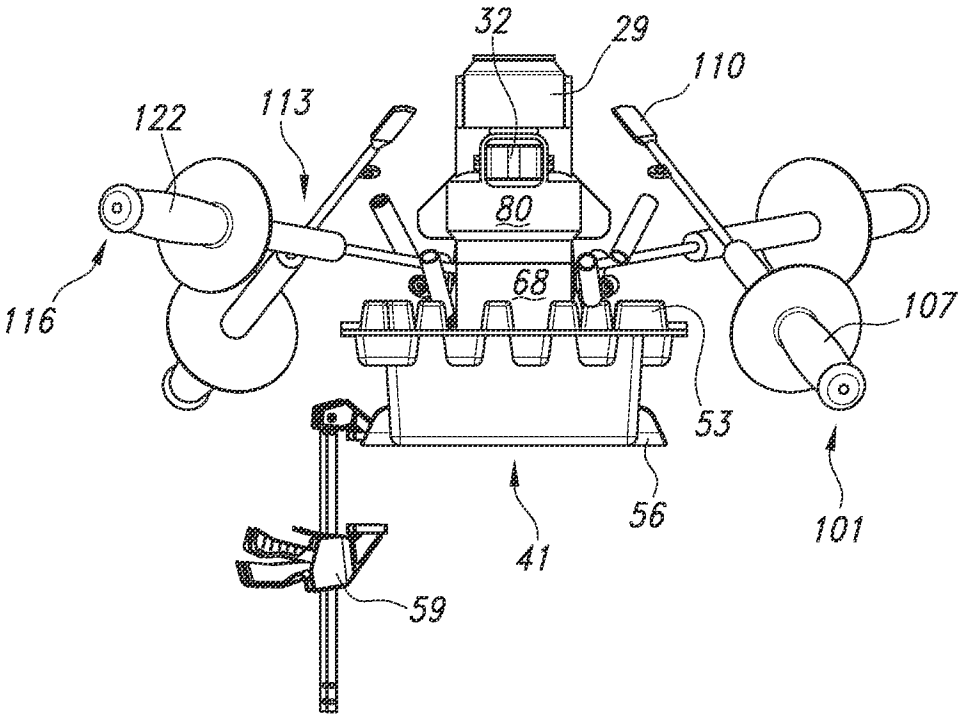
FIG. 4 is an end elevational view of the toy shown in FIG. 1.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 5:
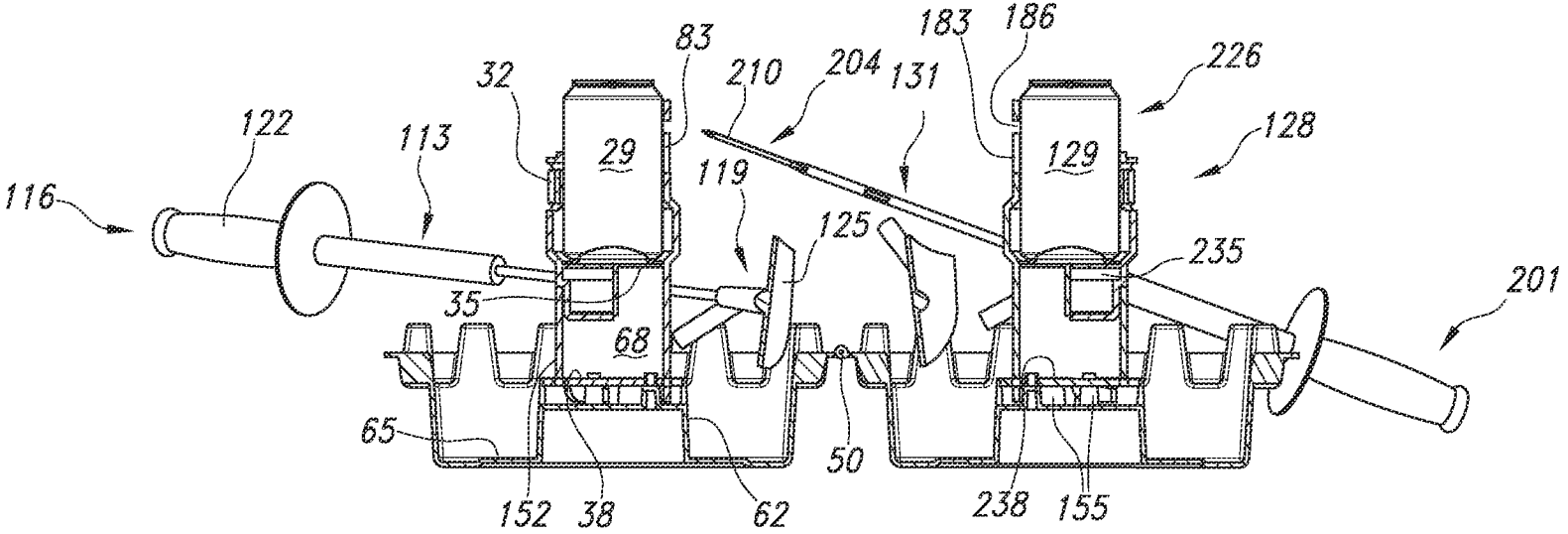
FIG. 5 is a cross-sectional view taken along lines 5-5 of FIG. 3.

Referring now to the drawings, and initially to FIGS. 1-5, the present invention provides a mechanical action toy 20. A first support member 23 may be formed of any suitable rigid material such as plastic, steel, wood or the like. The first support member 23 may be cylindrical in overall shape and may have a central opening 26 (best shown in FIG. 7) configured to receive a first beverage container 29. The first beverage container 29 may comprise a can such as a standard 12 or 16 ounce aluminum can. An adjustment mechanism 32 (FIG. 7) may be provided to accommodate beverage containers having different diameters. The first support member 23 may support the first beverage container 29 on a platform 35 disposed above a base 38 (FIG. 5).

The base 38 may be formed at the top of cylindrical portion 62 disposed on a clam shell type enclosure 41. Two equal compartments 44 and 47 may be connected at the middle by a hinge 50. The mechanical action toy 20 may be partially disassembled such that the parts fit inside the two halves of the enclosure 41. The enclosure 41 may be provided with a handle (not shown) for easily transporting the toy 20.

The inside of the enclosure 41 may be provided with a plurality of decorative upright projecting members 53 that resemble crenellations on a castle.

The enclosure 41 may be provided with a laterally projecting member 56 that is configured to be suitable for use with a C-shaped clamp 59 for attaching the enclosure 41 in the open configuration to a table (not shown) as shown in FIG. 1.

As shown, the first support member 23 may have a first cylindrical portion 62 extending above a bottom wall 65 (best shown in FIG. 5) formed inside the enclosure 41 when it is arranged in the open configuration shown in FIG. 1. The bottom wall 65 may be flat. The first cylindrical portion 62 of the first support member 23 may extend upward from the bottom wall 65. The top of cylindrical portion 62 may form the base 38. A second cylindrical portion 68 having a smaller diameter than the first cylindrical portion 62 may extend upward from the first cylindrical portion 62. The top surface of the second cylindrical portion 68 may form the platform 35 (FIG. 7) for supporting the first beverage container 29. Outward extending members 74, 77 (FIG. 3) resembling shoulders may extend from the sides of an enlarged diameter section 80 disposed above the second cylindrical portion 68.

Figure 9:
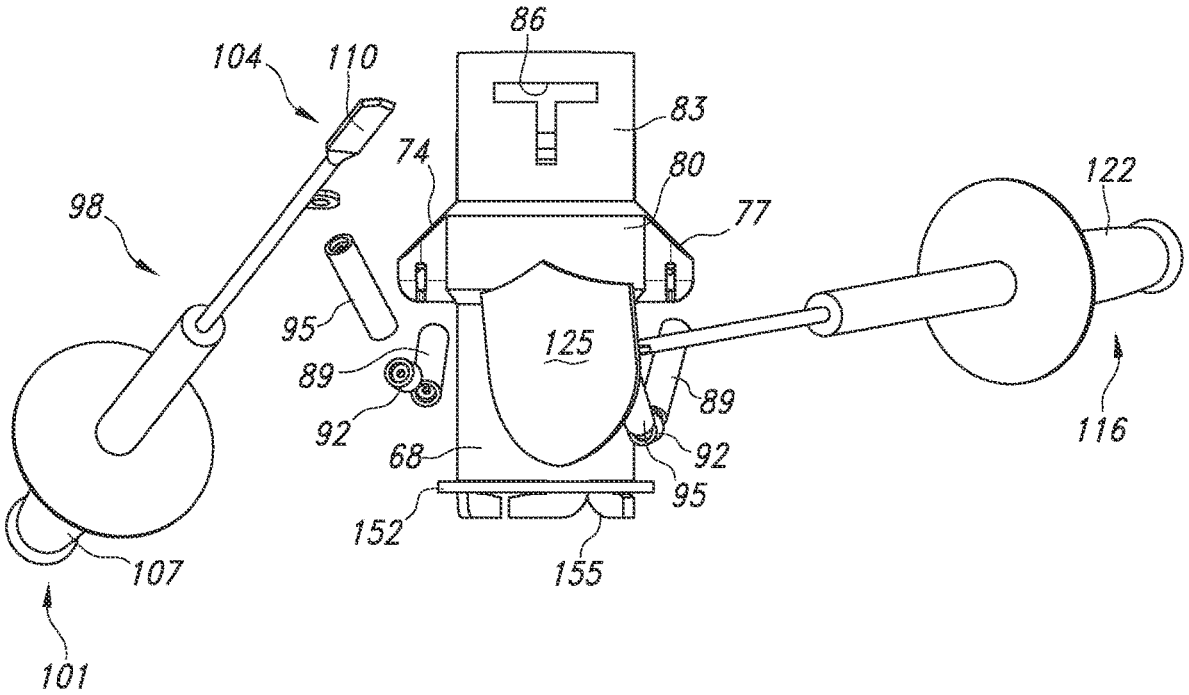
FIG. 9 is a front elevational view of the support member shown in FIG. 6.
Figure 10:
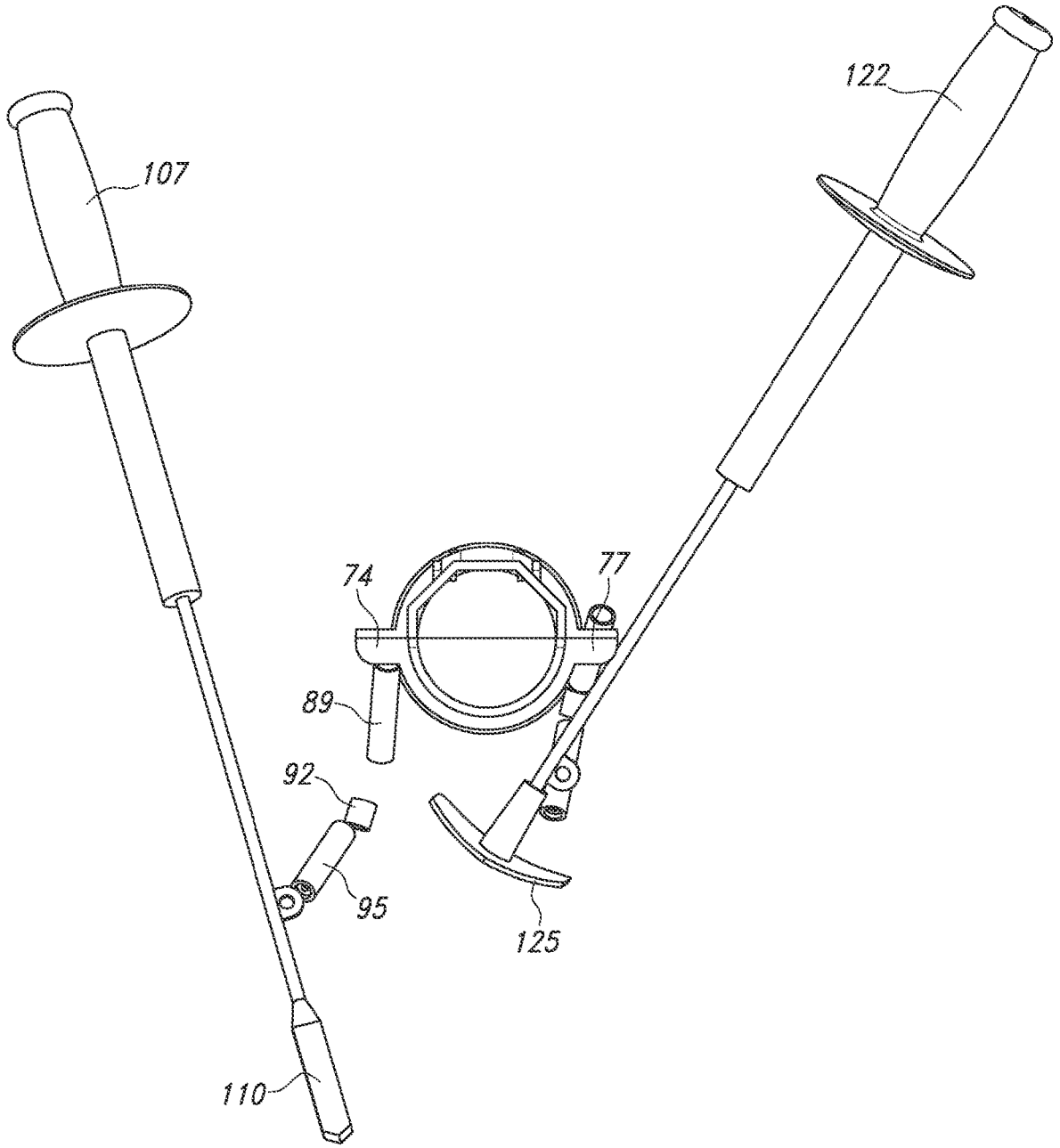
FIG. 10 is a top plan view of the support member shown in FIG. 6.
Figure 11:
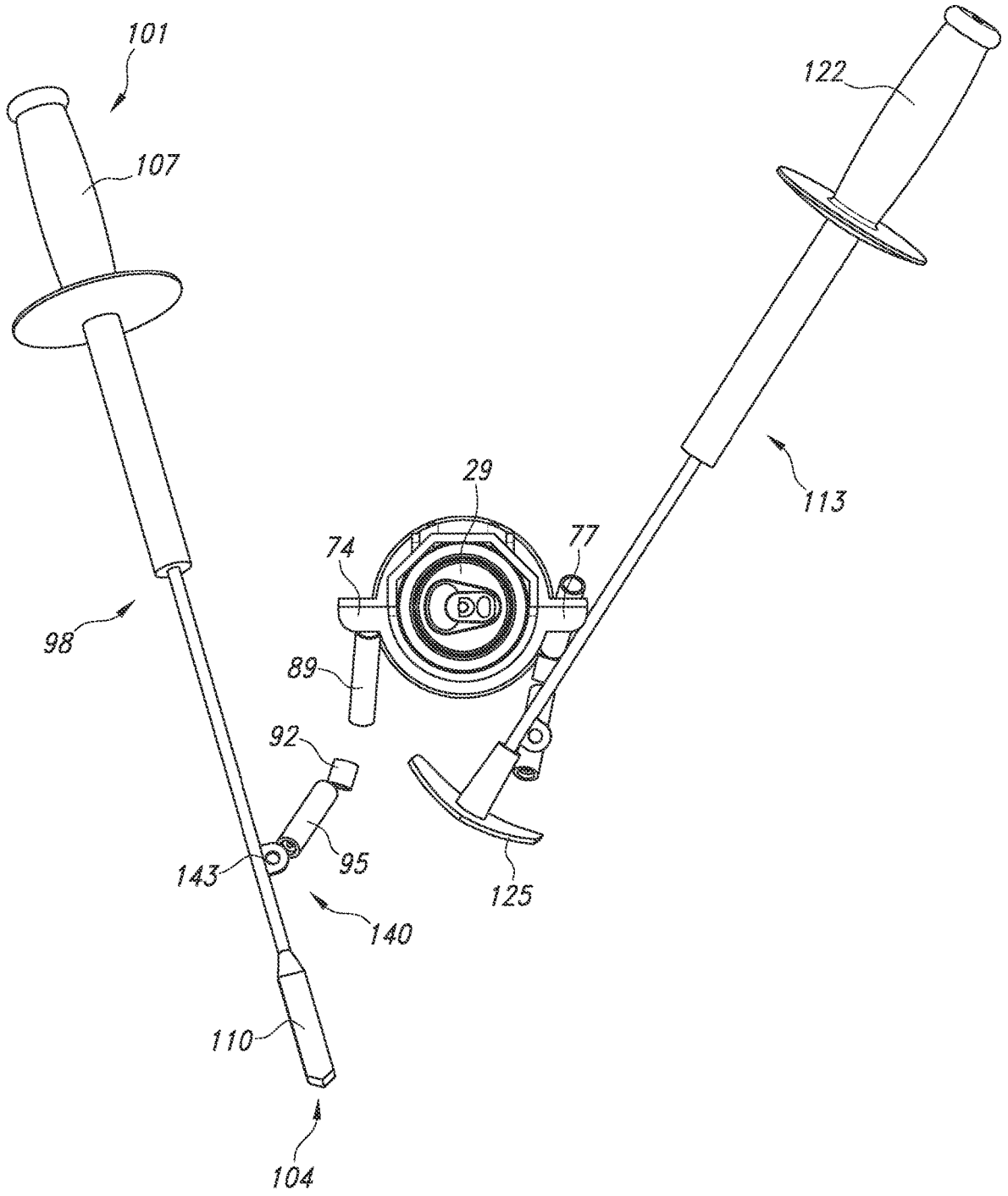
FIG. 11 is a top plan view of the support member shown in FIG. 6 with a beverage container installed therein.
Figure 12:
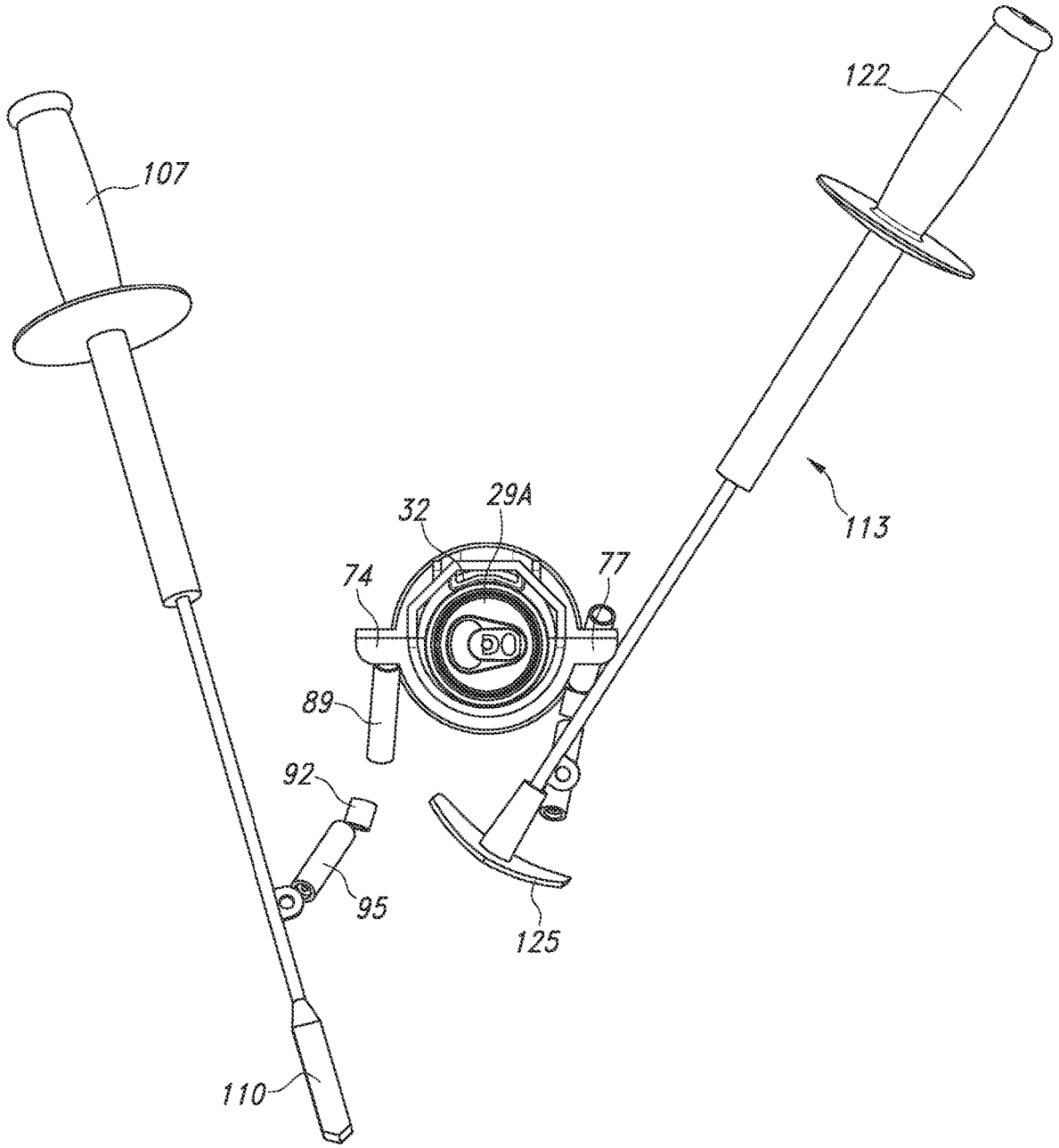
FIG. 12 is a top plan view of the support member shown in FIG. 6 with a beverage container having a smaller diameter installed therein.

A curved first plate 83 is disposed above the enlarged diameter section 80 and extends upward. The curved first plate 83 may be provided with an opening 86 which is shown in the shape of a "T" (best shown in FIG. 9).

As shown the first beverage container 29 is received in the first support member 23 in the central opening 26 disposed behind the curved plate 83.

Figure 6:
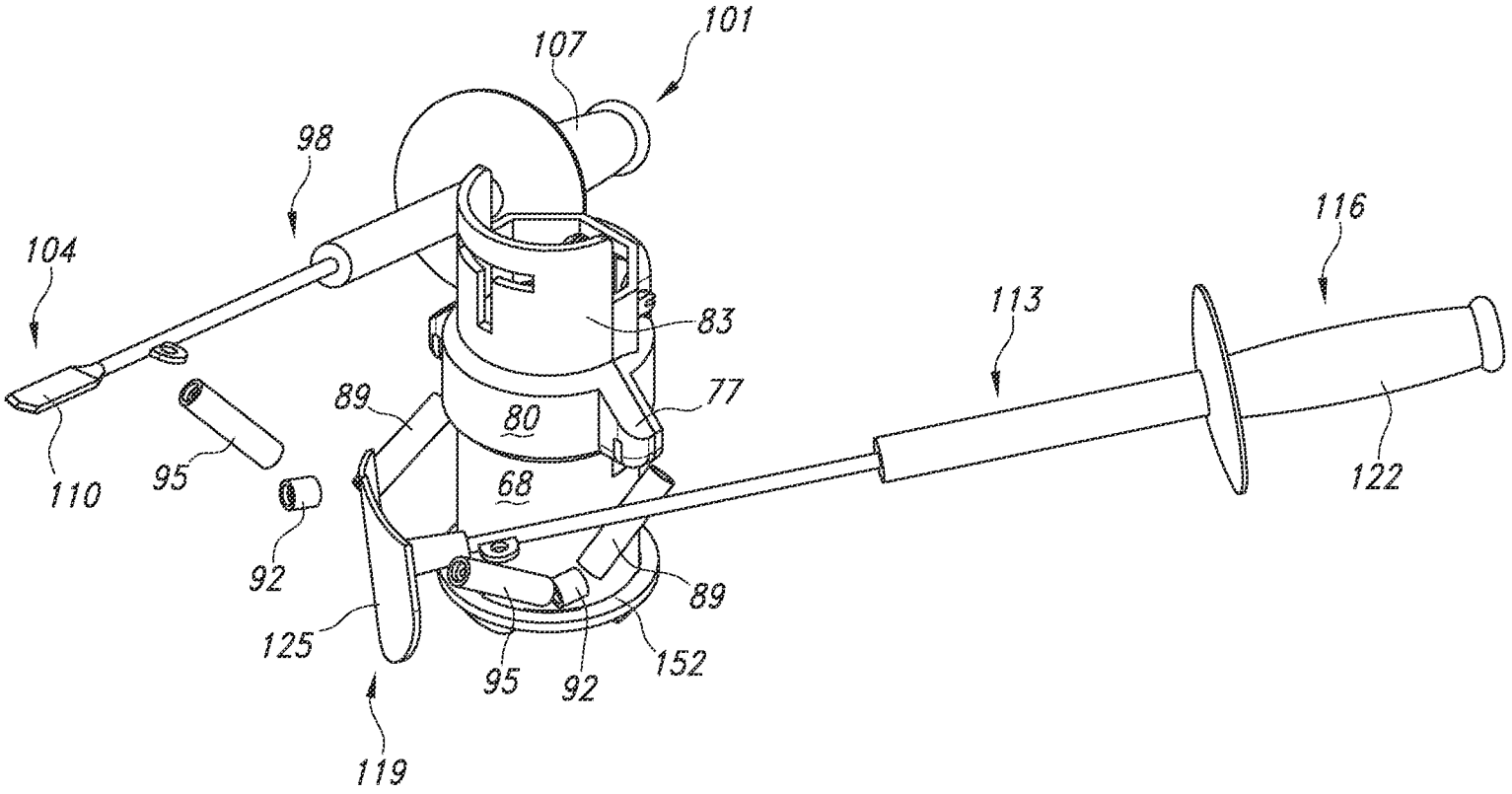
FIG. 6 is a front perspective view of one of the support members of the mechanical toy.

Referring to FIG. 6, the outward extending members 74, 77 may have pivotally connected longitudinal sections 89, 92, 95 that resemble arms attached to a body formed by the first support member 23 supporting the first beverage container 29.

A first elongate piercing member 98 having a first end 101 and a second end 104 may be connected to one of the outward extending members 74, 77 on the first support member 23.

The first elongate piercing member 98 may be provided with a handle 107 at the first end 101, and the second end 104 may be provided with a piercing member 110. A first elongate shield member 113 may be connected to the outward extending member 77 on the opposite side of the first support member 23 as shown in FIG. 1. The first elongate shield member 113 may have a first end 116 and a second end 119 opposite the first end 116. The first end 116 may be provided with a handle 122 and the second end 119 may be provided with a shield 125.

Returning to FIGS. 1-5, a second support member 128 may be supported on the base 38 in spaced apart, facing relation to the first support member 23. The second support member 128 supports a second beverage container 129. The second support member 128 may have similar construction to the first support member 23 described above. The second support member 128 may be connected to a second elongate piercing member 131 and a second elongate shield member 134 having similar construction to the first elongate piercing member 98 and the first elongate shield member 113 described above.

In use, the mechanical toy 20 provides a two player action game where the object of the game is to puncture the opponents beverage container 29, 129 by inserting the second end 104, 204 of the first or second elongate piercing members 98, 131 through the opening 86, 186 in the first or second plate 83, 183 on the opposing first or second support member 23, 128. Once the beverage container 29, 129 is punctured, the player must drink from the container 29, 129 until the fluid level in the beverage container 29, 129 goes below the site of the puncture or until the beverage container 29, 129 is empty.

Turning to FIGS. 6-12, the first support member 23 is shown in greater detail. The first support member 23 may have a base portion 149 (best shown in FIG. 8) with an outward extending flange 152. The base portion 149 may be supported by the base 38 on the first cylindrical portion 62 that extends upward from the bottom wall 65. The increased diameter section 80 may be disposed above the first cylindrical portion 62. The increased diameter section 80 may have an outwardly extending portion 74, 77 on each side resembling the shoulder of a knight figure. One or more elongate sections 89, 92, 95 may be connected to the outward extending portion 74, 77. The elongate sections 89, 92, 95 may be pivotally connected to form arm-like extensions resembling the arms of a puppet. The elongate sections 89, 92, 95 may extend from the outward extending portion 74, 77 on the first support member 23 to a distal end 140. The distal end 140 of the elongate sections 89, 92, 95 may be connected to the first or second elongate member 98, 113 through an eyelet 143 disposed on the first or second elongate members 98, 113. As shown in the exploded view of FIG. 6, there may be three elongate sections 89, 92, 95 forming the arm-like extension on the first support member 23. The first elongate member 23 has a piercing member 110 at the second end 104. The eyelet 143 is disposed on the second elongate member 113 in spaced apart relation to the distal end 140. The second elongate member 113 is provided with a shield 125 at the distal end 140.

Above the increased diameter section 80, a first plate 83 may be provided in the front and may be disposed in facing relation to the second support member 128. As shown, the first plate 83 is curved and may extend around a portion of the circumference of the first support member 23. The first plate 83 is shown with a T-shaped opening 86. Other sizes and shapes for the opening 86 in the first plate 83 may also be used.

Behind the first plate 83 is the first opening 26 for receiving a beverage container 29.

Figure 7:
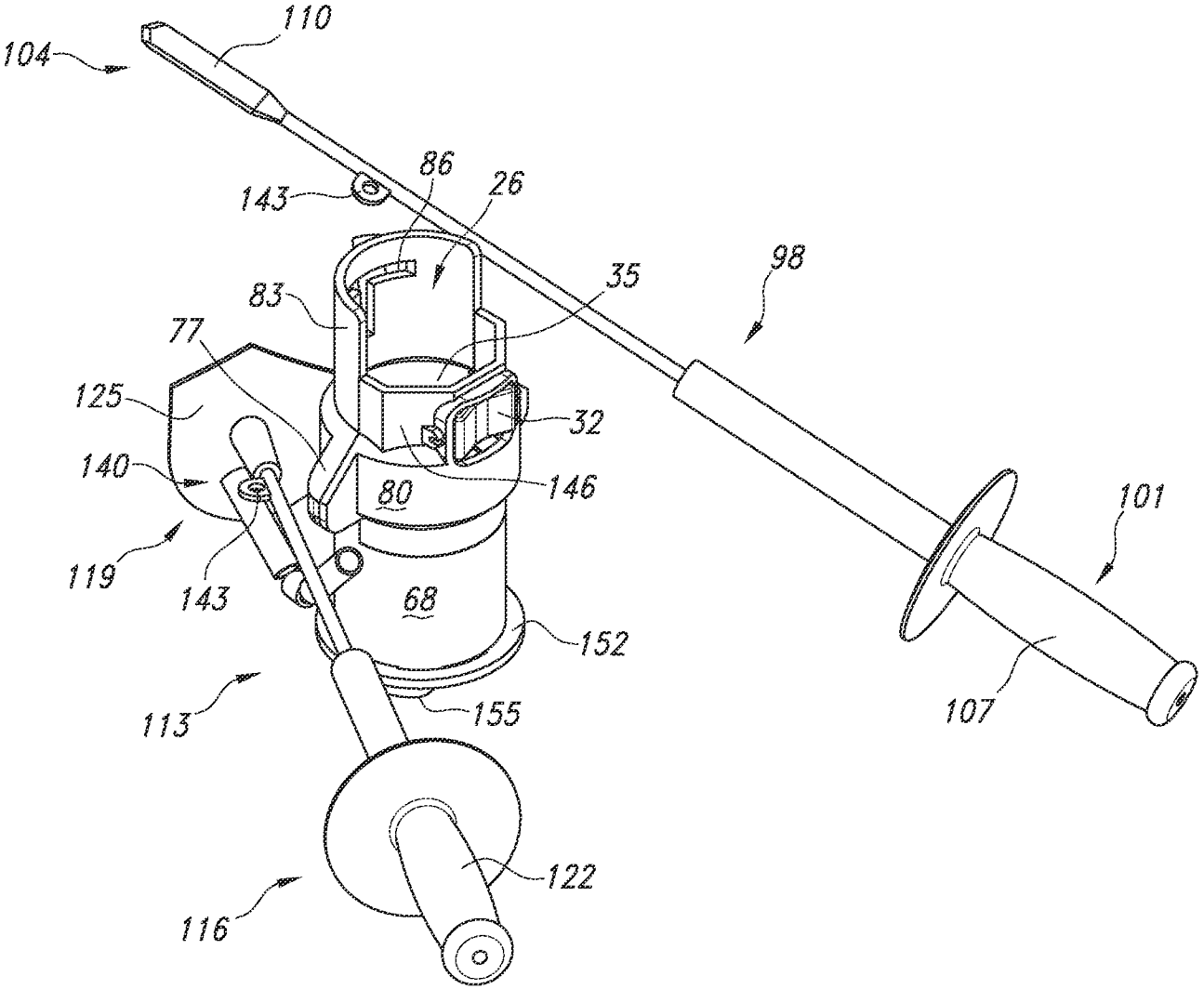
FIG. 7 is a rear perspective view of the support member shown in FIG. 6.

Turning to FIG. 7, the opening 26 is shown in greater detail. A curved back member 146 may be provided around the central opening 26 toward the back of the first support member 23. The curved back member 146 and the curved plate 83 may combine to form the perimeter around opening 26. The opening 26 is sized to correspond to a standard 12 ounce aluminum can. In order to accommodate cans having smaller diameters, the adjustment mechanism 32 provides a pivoting member that can be used to decrease the size of opening 26.

Figure 8:
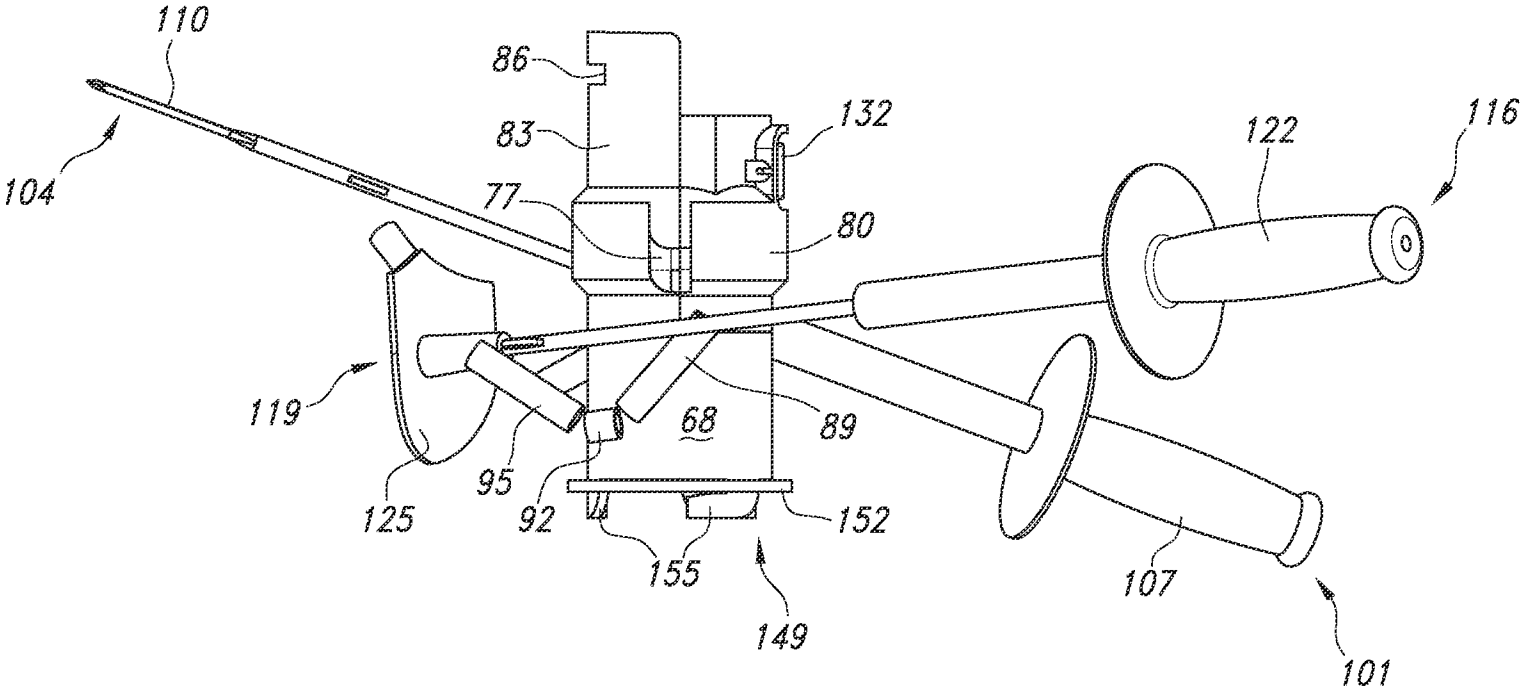
FIG. 8 is a side elevational view of the support member shown in FIG. 6.

In FIG. 8, the base 149 of the first support member 23 is shown in greater detail. The base 149 may be provided with a flange 152. A plurality of projections 155 may extend downward from the base 149. The projections 155 may be configured to be received in openings in the base 38. Rotation of the first support member 23 may cause the projections 155 to lock into position in the base 38 in quarter turn locking fashion as will be evident to persons of ordinary skill in the art based on this disclosure.

The present invention contemplates that many changes and modifications may be made. Therefore, while the presently-preferred form of the adaptor has been shown and described, and several modifications and alternatives discussed, persons skilled in this art will readily appreciate that various additional changes and modifications may be made without departing from the spirit of the invention, as defined and differentiated by the following claims.

The invention claimed is:

1. A mechanical action toy, comprising:

a first support member having an opening defined therein, the opening configured to receive at least a portion of a first beverage container to hold the first beverage container in a predetermined position;

a first elongate piercing member having a first end and a second end disposed opposite from the first end;

a second support member having an opening defined therein configured to receive at least a portion of a second beverage container to hold the second beverage container in a predetermined position, the second support member disposed in spaced apart relation to the first support member;

a second elongate piercing member having a first end and a second end disposed opposite from the first end;

wherein the second end of the first elongate piercing member is configured to puncture the second beverage container and the second end of the second elongate piercing member is configured to puncture the first beverage container;

wherein the first elongate piercing member is connected to the first support member.

2. The toy of claim 1, wherein the first elongate piercing member is connected to the first support member by a plurality of elongate connectors.

3. The toy of claim 1, the second elongate piercing member is connected to the second support member.

4. The toy of claim 1, further comprising a base supporting the first and second support members.

5. The toy of claim 4, further comprising a platform disposed on the first support member, the platform configured to support the first beverage container in a position elevated from the base.

6. The toy of claim 4, wherein the base is formed in a clamshell type enclosure.

7. The toy of claim 1, further comprising a first laterally extending member configured to form a shoulder extending from the first support member.

8. The toy of claim 7, further comprising one or more connecting members, the one or more connecting members attached at a first end to the first support member and attached at a second end to the first elongate piercing member.

9. The toy of claim 1, further comprising a first elongate shield member having a first end and a second end disposed opposite from the first end.

10. The toy of claim 9, further comprising a second elongate shield member having a first end and a second end disposed opposite from the first end, the second elongate shield member disposed in spaced apart relation to the first elongate shield member.

11. A mechanical action toy, comprising:

a first support member having an opening defined therein, the opening configured to receive at least a portion of a first beverage container to hold the first beverage container in a predetermined position;

a first elongate piercing member having a first end and a second end disposed opposite from the first end;

a second support member having an opening defined therein configured to receive at least a portion of a second beverage container to hold the second beverage container in a predetermined position, the second support member disposed in spaced apart relation to the first support member;

a second elongate piercing member having a first end and a second end disposed opposite from the first end;

wherein the second end of the first elongate piercing member is configured to puncture the second beverage container and the second end of the second elongate piercing member is configured to puncture the first beverage container;

further comprising a first plate disposed on the first support member in front of the first beverage container, the first plate having an opening defined therein, the first plate covering at least a portion of the first beverage container.

12. A mechanical action toy, comprising:

a base;

a first support member supported by the base, the first support member having an opening defined therein, the opening configured to receive at least a portion of a first beverage container to hold the first beverage container in a predetermined position on a platform disposed above the base;

a first plate covering at least a portion of a front surface of the first beverage container, the first plate having an opening defined therein;

a first elongate piercing member having a first end and a second end disposed opposite from the first end, the first elongate piercing member connected to the first support member;

a first elongate shield member having a first end and a second end disposed opposite from the first end, the first elongate shield member connected to the first support member, the first elongate shield member having a shield disposed at the second end;

a second support member having an opening defined therein configured to receive at least a portion of a second beverage container to hold the second beverage container in a predetermined position on a platform above the base, the second support member disposed in spaced apart relation to the first support member;

a second plate covering at least a portion of a front surface of the second beverage container, the second plate having an opening defined therein;

a second elongate piercing member having a first end and a second end disposed opposite from the first end, the second elongate piercing member connected to the second support member;

a second elongate shield member having a first end and a second end disposed opposite from the first end, the second elongate shield member connected to the second support member, the second elongate shield member having a shield disposed at the second end;

wherein the first elongate piercing member is configured to puncture the second beverage container through the opening in the second plate and the second elongate piercing member is configured to puncture the first beverage container through the opening in the first plate.

13. The toy of claim 12, wherein the base is formed in a clam shell type enclosure.

14. The toy of claim 12, further comprising a first laterally extending member configured to form a shoulder extending from the first support member.

15. The toy of claim 12, further comprising one or more connecting members, the one or more connecting members attached at a first end to the first support member and attached at a second end to the first elongate piercing member.

16. A mechanical action toy, comprising:

a base;

a first support member supported by the base, the first support member having an opening defined therein, the opening configured to receive at least a portion of a first beverage container to hold the first beverage container in a predetermined position on a platform disposed above the base;

a first plate disposed on the first support member, the first plate covering at least a portion of the first beverage container and having an opening defined therein;

a first elongate piercing member having a first end and a second end disposed opposite from the first end, the first elongate piercing member connected to the first support member;

a first elongate shield member having a first end and a second end disposed opposite from the first end, the first elongate shield member connected to the first support member, the first elongate shield member having a shield disposed at the second end;

a second support member having an opening defined therein configured to receive at least a portion of a second beverage container to hold the second beverage container in a predetermined position on a platform above the base, the second support member disposed in spaced apart relation to the first support member;

a second plate disposed on the second support member, the second plate covering at least a portion of the second beverage container and having an opening defined therein;

a second elongate piercing member having a first end and a second end disposed opposite from the first end, the second elongate piercing member connected to the second support member;

a second elongate shield member having a first end and a second end disposed opposite from the first end, the second elongate shield member connected to the second support member, the second elongate shield member having a shield disposed at the second end;

wherein the second end of the first elongate piercing member is configured to puncture the second beverage container through the opening in the second plate in the second support member and the second end of the second elongate piercing member is configured to puncture the first beverage container through the opening in the first plate in the first support member.

* * * * *